US010966453B2

(12) United States Patent
Fallon et al.

(10) Patent No.: US 10,966,453 B2
(45) Date of Patent: Apr. 6, 2021

(54) FLAVOURING COMPONENT, AND APPARATUS AND METHOD FOR MANUFACTURING A FLAVOURING COMPONENT

(71) Applicant: British American Tobacco (Investments) Limited, London (GB)

(72) Inventors: Gary Fallon, London (GB); Kie Seon Park, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 228 days.

(21) Appl. No.: 15/570,459

(22) PCT Filed: Apr. 26, 2016

(86) PCT No.: PCT/GB2016/051176
§ 371 (c)(1),
(2) Date: Oct. 30, 2017

(87) PCT Pub. No.: WO2016/174417
PCT Pub. Date: Nov. 3, 2016

(65) Prior Publication Data

US 2018/0140003 A1 May 24, 2018

(30) Foreign Application Priority Data

Apr. 29, 2015 (GB) ..... 1507269

(51) Int. Cl.

| | |
|---|---|
| ***A24D 3/02*** | (2006.01) |
| ***A24C 5/18*** | (2006.01) |
| ***A24D 1/00*** | (2020.01) |
| ***A24D 3/04*** | (2006.01) |
| ***A24B 3/12*** | (2006.01) |

(52) U.S. Cl.
CPC ..... *A24D 3/0225* (2013.01); *A24C 5/1892* (2013.01); *A24D 1/002* (2013.01); *A24D 3/048* (2013.01); *A24B 3/12* (2013.01)

(58) Field of Classification Search
None
See application file for complete search history.

(56) References Cited

U.S. PATENT DOCUMENTS

| | | | |
|---|---|---|---|
| 2,904,050 | A | 1/1955 | Kiefer |
| 3,390,039 | A | 6/1968 | Caughman |

(Continued)

FOREIGN PATENT DOCUMENTS

| | | | |
|---|---|---|---|
| CN | 103876285 | A | 6/2014 |
| DE | 1532148 | | 7/1970 |

(Continued)

OTHER PUBLICATIONS

Korean Office Action for corresponding application 1991-0015746; Report dated Sep. 26, 2019.

(Continued)

*Primary Examiner* — Michael J Felton
(74) *Attorney, Agent, or Firm* — Cantor Colburn LLP

(57) ABSTRACT

A flavouring component (43) for a smoking article (50) comprising a rod (33) of flavouring material (17). The flavouring material (17) comprises a carrier material (15) and flavouring particles (14) adhered to the carrier material (15) by means of a binder (13). The flavouring material (17) is formed by passing the carrier material (15) through a mixture (12) comprising the binder (13) and the flavouring particles (14). Also disclosed is a smoking article (50) including such a flavouring component (43), and an apparatus (10) and method for manufacturing such a flavouring component (43).

15 Claims, 3 Drawing Sheets

(56) References Cited

U.S. PATENT DOCUMENTS

| | | | | |
|---|---|---|---|---|
| 4,655,230 | A | 4/1987 | Bryant | |
| 4,756,316 | A | 7/1988 | Keritsis | |
| 4,821,749 | A | 4/1989 | Toft | |
| 5,429,575 | A * | 7/1995 | Armour | A24D 3/0204 226/97.1 |
| 7,074,170 | B2 * | 7/2006 | Lanier, Jr. | A24D 3/022 493/39 |
| 2003/0224918 | A1 | 12/2003 | Lanier, Jr. et al. | |
| 2013/0085052 | A1 | 4/2013 | Novak, III | |
| 2013/0206151 | A1 | 8/2013 | Besso | |
| 2015/0181929 | A1 * | 7/2015 | Lisan | A24D 3/043 131/332 |

FOREIGN PATENT DOCUMENTS

| | | | |
|---|---|---|---|
| EP | 0196867 | A2 | 10/1986 |
| GB | 1037435 | | 7/1966 |
| GB | 1059421 | | 2/1967 |
| GB | 1098462 | | 7/1968 |
| JP | S61224978 | A | 10/1986 |
| JP | 2008521429 | A | 6/2008 |
| JP | 2010505423 | A | 2/2010 |
| KR | 19910015746 | A | 9/1991 |
| WO | 2006090290 | A1 | 8/2006 |
| WO | 2011118042 | A1 | 9/2011 |
| WO | 2011125907 | A1 | 10/2011 |
| WO | 2014097476 | A1 | 6/2014 |

OTHER PUBLICATIONS

International Search Report for corresponding application PCT/GB2016/051176 filed Apr. 26, 2016; dated Jul. 26, 2016.

Written Opinion for corresponding application PCT/GB2016/051176 filed Apr. 26, 2016; dated Jul. 26, 2016.

Korean Office Action for corresponding application 10-2017-7031255; Report dated Nov. 21, 2019.

* cited by examiner

FLAVOURING COMPONENT, AND APPARATUS AND METHOD FOR MANUFACTURING A FLAVOURING COMPONENT

TECHNICAL FIELD

The present invention relates to an apparatus and method for manufacture of flavouring components and, in particular, an apparatus and method for manufacture of flavouring components for use in smoking articles.

BACKGROUND

It is known to incorporate smoke-modifying agents in the body of smoking articles to provide flavouring or other smoke or aerosol modification to smoking articles. Flavourant granules may be incorporated into the filter rod or the wrapping paper of a cigarette or other type of smoking article in order to enhance the flavour of the inhaled smoke or other aerosol.

It is desirable to provide an alternative flavouring component, and apparatus and process for manufacturing a flavouring component for use in a smoking article.

SUMMARY

In this specification there are described embodiments of a flavouring component for a smoking article, the flavouring component comprising a rod of flavouring material, the flavouring material comprising a carrier material and flavouring particles adhered to the carrier material by means of a binder, wherein the flavouring material is formed by passing the carrier material through a mixture comprising the binder and the flavouring particles.

The carrier material may be a fibrous web and the flavouring particles may adhere to the fibres of the web. The carrier material may be made from one of the following materials: aluminium, tobacco, ceramic, cotton.

The mixture through which the carrier material is passed to form the flavouring material may have a doughy consistency.

The flavouring component may comprise a discrete rod of flavouring material cut from a continuous rod of flavouring material.

The flavouring component may comprise an outer wrap around the rod of flavouring material.

In the present specification there are also described embodiments of a smoking article comprising a rod of smokeable material, a filter rod, and a flavouring component as described above.

The flavouring component may be disposed between the filter rod and the rod of smokeable material.

In the present specification there are also described embodiments of an apparatus for manufacturing a flavouring component for a smoking article, the flavouring component comprising a rod of flavouring material, the flavouring material comprising a carrier material and flavouring particles adhered to the carrier material by means of a binder, the apparatus comprising a container containing a mixture of the binder and the flavouring particles, the container comprising an outlet, and a supply of carrier material, wherein the apparatus is configured to convey a length of carrier material through the mixture within the container so that the flavouring particles adhere to the length of carrier material by means of the binder to form a length of flavouring material, and is configured to convey the length of carrier material out of the outlet extrude the length of flavouring material to form the rod of flavouring material.

The length of carrier material may be a continuous length of carrier material, and the apparatus may be configured to convey the continuous length of carrier material through the mixture so that the flavouring particles adhere to the continuous length of carrier material by means of the binder to form a continuous length of flavouring material, and may be configured to extrude the continuous length of flavouring material to form a continuous rod of flavouring material.

The mixture may have a doughy consistency.

The apparatus may comprise means for conveying the mixture towards the outlet of the container. The conveying means may comprise a screw conveyor located in the container and facing the outlet of the container. Alternatively, or in addition, the conveying means may comprise means for pressurising the mixture in the container.

The apparatus may comprise means for pulling the length of flavouring material out of the container through the outlet.

The outlet may comprise a die and the die may be configured to shape the extruded length of flavouring material as the length of flavouring material is expelled through the outlet to form the rod of flavouring material.

The die may be configured to provide a helical profile to the rod of flavouring material.

The apparatus may comprise means for twisting the length of carrier material as it is conveyed through the mixture.

The apparatus may comprise an injection nozzle configured to inject an amount of binder in the container.

The apparatus may comprise a wrapping station configured to provide an outer wrap around the rod of flavouring material.

The wrapping station may be configured to pull the length of flavouring material out of the container through the outlet.

The apparatus may comprise a cutting station configured to cut the rod of flavouring material into discrete rods of flavouring material.

In the present specification there are also described embodiments of a method of manufacturing a flavouring component for a smoking article, the flavouring component comprising a rod of flavouring material, the flavouring material comprising a carrier material and flavouring particles adhered to the carrier material by means of a binder, the method comprising filling a container with a mixture comprising the binder and the flavouring particles, the container having an outlet, supplying a length of carrier material, conveying the length of carrier material through the mixture within the container towards the outlet so that the flavouring particles adhere to the length of carrier material by means of the binder to form a length of flavouring material, and conveying the length of the carrier material out of the outlet to extrude the length of flavouring material to form the rod of flavouring material.

The length of carrier material may be a continuous length of carrier material, and the method may comprise conveying the continuous length of carrier material through the mixture so that the flavouring particles adhere to the continuous length of carrier material by means of the binder to form a continuous length of flavouring material, and extruding the continuous length of flavouring material to form a continuous rod of flavouring material.

The method may comprise conveying the mixture towards the outlet of the container.

The method may comprise using a screw conveyor to convey the mixture towards the outlet of the container.

The method may comprise pulling the length of flavouring material out of the container through the outlet.

The method may comprise using a die to shape the extruded length of flavouring material as the length of flavouring material is expelled through the outlet.

The method may comprise using the die to provide a helical profile to the length of flavouring material as the length of flavouring material passes through the die.

The method may comprise twisting the length of carrier material as it is conveyed through the mixture.

The method may comprise using an injection nozzle to inject an amount of binder in the container.

The method may comprise using a wrapping station to provide an outer wrap around the rod of flavouring material.

The method may comprise using the wrapping station to pull the length of flavouring material out of the container through the outlet.

The method may comprise cutting the rod of flavouring material into discrete rods of flavouring material.

BRIEF DESCRIPTION OF THE DRAWINGS

Embodiments of the invention will now be described, by way of example only, with reference to the accompanying drawings, in which.

DETAILED DESCRIPTION

Figure 1:
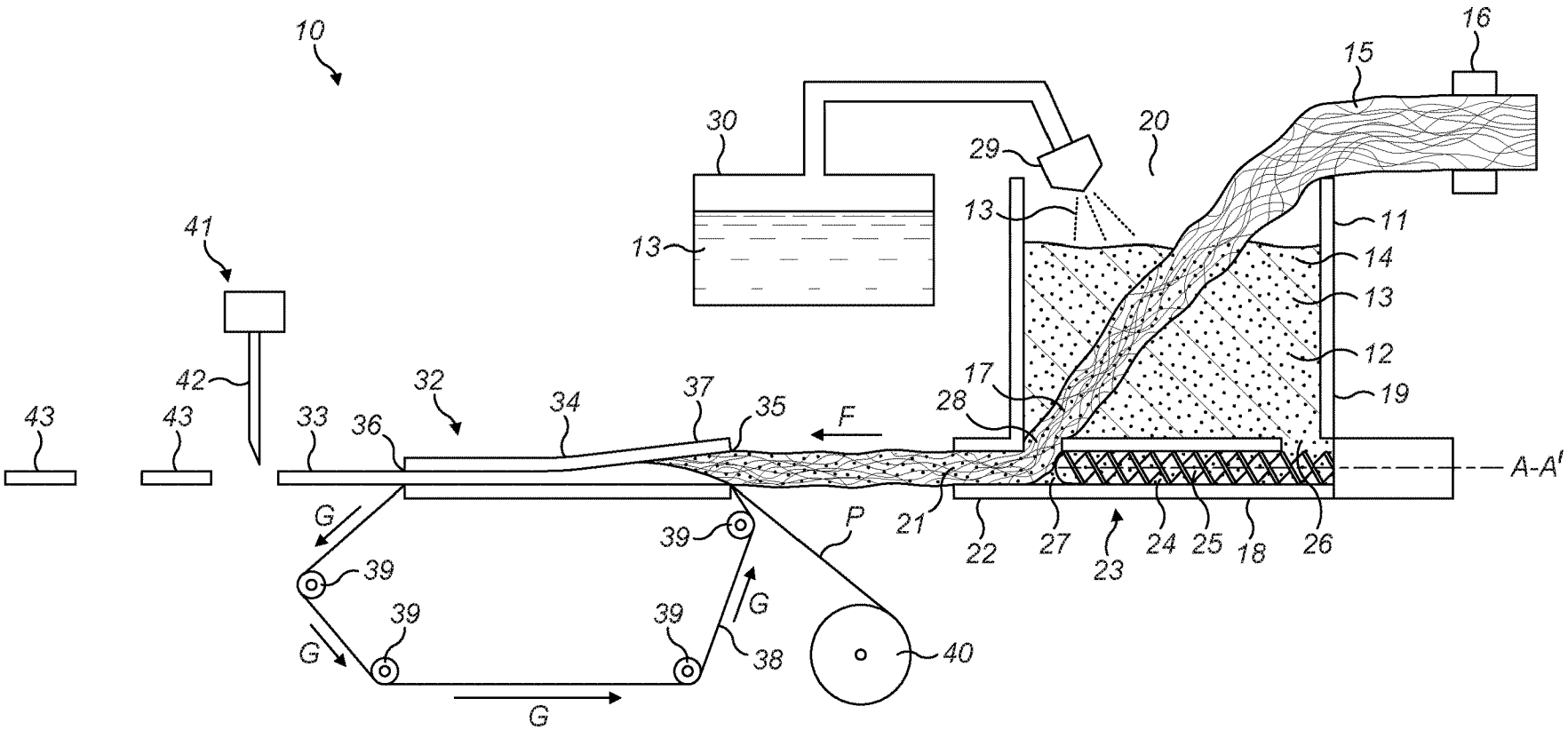
FIG. 1 shows a schematic cross-sectional view of a first embodiment of an apparatus of the invention.

FIG. 1 shows an apparatus 10 of a first embodiment of the invention for the manufacture of flavouring components for smoking articles.

The apparatus 10 comprises a container or bath 11 filled with a mixture 12 comprising a binder 13 and flavouring particles 14. The apparatus 10 also comprises a supply of carrier material 15 in the form of a carrier material spool 16. The apparatus 10 is configured to convey a continuous length of carrier material 15 from the carrier material spool 16 through the mixture 12 so that the flavouring particles 14 adhere to the carrier material 15 by means of the binder 13, to form a continuous length of flavouring material 17.

The carrier material 15 is the form of a continuous fibrous web so that the flavouring particles 14 adhere to the fibres of the web and/or get embedded between the fibres of the web by means of the binder 13. In a variant (not shown), the carrier material 15 is in the form of a continuous strand having an external surface to which the flavouring particles 14 may adhere by means of the binder 13. The carrier material 15 is made from a heat conductive material such as aluminium. Alternatively, the carrier material 15 may be made from another material such as tobacco, ceramic or cotton.

The binder 13 is configured to provide adhesive properties to the mixture 12 so that the mixture 12 can adhere to the carrier material 15. The binder 13 provides a doughy consistency to the mixture 12. The doughy consistency of the mixture prevents the mixture 12 from flowing out of the container by itself. In the present embodiment, the binder 13 is made with glue diluted in water. However, it will be noted that any other kind of binder suitable for providing sticky properties to the mixture 12 can be used. For example, the binder may be made with flour diluted in water.

The flavouring particles 14 are in the form of beads coated with one or more flavouring ingredients, such as menthol, vanillin, benzaldehyde, cinamaldehyde, furaneol, herb oils, spice oils or citrus oils. The flavouring particles 14 also include a binder which is, for example, similar to the binder 13 of the mixture 12. In the present embodiment, the flavouring particles 14 have a substantially spherical shape and have a diameter comprised between 0.2 mm and 3 mm.

The container 11 comprises a base portion 18, a sidewall 19 extending from the base portion 18, an upper aperture 20 located opposed to the base portion 18, and an outlet 21. The outlet 21 is formed in the sidewall 19 and is located proximate to the base portion 18. The outlet 21 is in the form of duct 22 extending outwardly from the sidewall 19 of the container 11.

A screw conveyor 23 is provided in the container 11. The screw conveyor 23 is disposed along the base portion 18. The screw conveyor 23 comprises a conveying chamber 24 and a conveying screw 25 extending in the conveying chamber 24. The conveying chamber 24 comprises an entrance opening 26 and an exit opening 27. The exit opening 27 faces the outlet 21 of the container 11. The conveying screw 25 has a longitudinal axis A-A' extending substantially parallel to the base portion 18. The conveying screw 25 is configured to rotate about the longitudinal axis A-A' in the conveying chamber 24 to convey the mixture 12 from the entrance opening 26 towards the exit opening 27 and towards the outlet 21. A passageway 28 is provided between the outlet end of the conveying chamber 24 and the adjacent sidewall 19 of the container 11 through which the length of carrier material 15 may be conveyed towards the outlet 21, along with the entrained mixture 12 fed from the conveying chamber 24 via the exit opening 27.

A spray nozzle 29 is provided at the upper aperture 20 of the container 11. The spray nozzle 29 is in fluid communication with a reservoir 30 where the binder 13 is stored. The spray nozzle 29 is configured to inject an amount of binder 13 in the container 11. For example, the spray nozzle 29 is configured to fill the container 11 with additional binder 13 when the quantity of mixture 12 in the container 11 is getting low. Alternatively, the reservoir 30 stores the mixture 12 comprising the binder 13 and the flavouring particles 14, and the spray nozzle 29 is configured to inject an amount of the mixture 12 in the container 11.

The apparatus 10 may be configured to twist the length of carrier material 15 as it is conveyed through the container 11. For example, the outlet duct 22 may have projections helically formed on the inside surface of the duct 22. Twisting the carrier material 15 as it is conveyed through the mixture 12 allows a significant quantity of flavouring particles 14 to adhere to the carrier material 15.

A wrapping station 32 is provided downstream of the container outlet 21. The wrapping station 32 is configured to wrap the extruded length of flavouring material 17 formed in the container 11 to form a wrapped extruded rod 33 of flavouring material 17. The wrapping station 32 comprises a 'garniture' 34 in the form of a tube, having a wide entrance aperture 35 and a narrow exit aperture 36, as substantially known in the art. The garniture 34 narrows between the wide entrance aperture 25 and the narrow exit aperture 36 at a tapered guide portion 37. The garniture 34 is generally circular in cross-section. A continuous 'garniture belt' 38 extends through the garniture 34 and over a plurality of guide rollers 39. The garniture belt 38 is driven to be conveyed around the rollers 39 in the direction shown by arrows 'G'. The garniture belt 38 is configured to pull the length of flavouring material 17 out of the container outlet 21, and to convey the length of flavouring material 17 through the garniture 34. As the length of flavouring material 17 is conveyed through the garniture 34, the length of flavouring material 17 goes from being loose when it enters the wide entrance aperture 35 to a more compressed rod 33 of flavouring material 17 as it leaves the narrow exit aperture 36. A wrapping paper 'P', also known as outer wrap or plug wrap, may be fed from a wrapping paper spool 40 onto the upper surface of the garniture belt 38 and is conveyed through the garniture 34 by the moving garniture belt 38. As the wrapping paper P travels though the garniture 34, the shape of the tapered guide portion 37 deforms the garniture belt 38 and the wrapping paper P thereon such that, in cross-section, the wrapping paper P goes from being flat (as it is on the spool) when it enters the wide entrance aperture 35 of the garniture 34, to a closed circle as it leaves the narrow exit aperture 36 of the garniture 34, completely surrounding the rod 33 of flavouring material. As the wrapping paper P is wrapped around the flavouring material 17, the edges meet to form a seam at an upper portion of the garniture 34. This seam may then be glued (or the wrapping paper may be pre-glued where the seam is to be formed). A section of the upper portion of the garniture 34 may comprise a heating bar (not shown) to heat and activate the glue at the seam of the wrapping to adhere the wrapping in place around the rod of flavouring material.

A cutting station 41 is provided downstream of the wrapping station 32. The cutting station 41 includes a cutting blade 42. The cutting station 41 is configured to cut the wrapped rod 33 of flavouring material 17 into individual lengths of discrete rods of flavouring material 17 or flavouring components 43.

In use, the container 11 is filled with the mixture 12 containing the binder 13 and the flavouring particles 14. The garniture belt 38 is driven over the rollers 29 in the direction shown by the arrows 'G'. A length of carrier material 15 is conveyed from the carrier material spool 16, into the container 11 through the upper aperture 20, out of the container 11 through the outlet 21 and into the garniture 34, by means of the garniture belt 38. The screw conveyor 23 rotates about the axis A-A' and conveys the mixture 12 towards the outlet 21 of the container 11.

As the carrier material 15 is conveyed in the container 11, the carrier material 15 passes through the mixture 12 and the binder 13 along with the flavouring particles 14 adhere to the carrier material 15 and thereby form a length of flavouring material 17.

The carrier material 15 is twisted by the twisting means as it passes through the mixture 12 in the container n thereby promoting an increased quantity of flavouring particles 14 to adhere to the carrier material 15.

After passing through the outlet 21 of the container 11, the length of flavouring material 17 is conveyed in the wrapping station 32. The length of flavouring material 17 passes through the wide entrance aperture 35 of the garniture 34, as shown by arrow 'F', and is guided into the tapered guide portion 37 of the garniture 34 by the garniture belt 38. The garniture belt 38 serves to guide the length of flavouring material 17 into the wide entrance aperture 35. The flavouring material 17 is conveyed through the tapered guide portion 37 so that the flavouring material 17 is extruded and formed into a compacted rod as it emerges from the narrow exit aperture 36. As the length of flavouring material 17 travels through the garniture 34 and is compressed, the wrapping paper P is folded around the outside of the compressed rod and glue is applied to the seam and heated to activate the glue, such that when the flavouring material 17 exits though the narrow exit aperture 36 of the garniture 34, the flavouring material 17 is formed into a compressed cylindrical rod 33 of flavouring material 17 enveloped by the wrapping paper P.

After the wrapped rod 33 of flavouring material 17 exits the wrapping station 32, it passes to the cutting station 41 where the cutting blade 42 cuts the wrapped rod 33 of flavouring material 17 into individual lengths of discrete rods of flavouring material 17 or flavouring components 43.

After the flavouring component 43 exits the cutting station 41, the flavouring component 43 is combined with a tobacco rod and a filter rod to form a smoking article.

Figure 2:
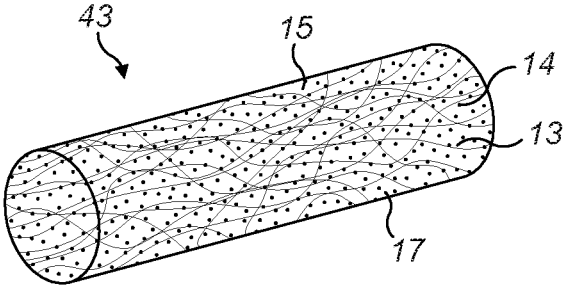
FIG. 2 shows a flavouring component manufactured using the apparatus shown in FIG. 1.

A flavouring component 43 of the invention manufactured using the above-described apparatus and method is shown in FIG. 2. The flavouring component 43 is shown in FIG. 2 without the wrapping paper P. The flavouring component 43 is substantially cylindrical and is continuous in cross-section along its length. It comprises a rod of flavouring material 17 comprising the fibrous web of carrier material 15 and the mixture 12 of binder 13 and flavouring particles 14 adhered to the fibres of the web. The fibrous web of flavouring material 17, although extruded, comprises spaces between the fibres so that air can flow through the fibres. In an alternative arrangement (not shown), the flavouring component 43 could be disposed within a tube.

Figure 3:
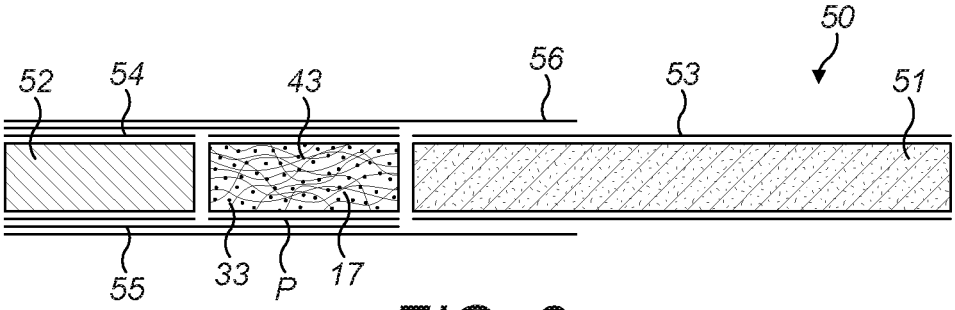
FIG. 3 shows a schematic cross-sectional view of an embodiment of a smoking article including a flavouring component of the invention.

FIG. 3 shows an exemplary configuration of a smoking article 50 incorporating a flavouring component 43 of the invention. The smoking article 50 comprises a tobacco rod 51, a filter rod 52, and the flavouring component 43 formed by a discrete wrapped rod 33 of flavouring material 17. The flavouring component 43 is located between the tobacco rod 51 and the filter rod 52. A tobacco rod wrap 53 is disposed about the tobacco rod 51. Likewise, a filter plug wrap 54 is disposed about the filter rod 52. The filter rod 52 and the flavouring component 43 are held together by means of an outer plug wrap 55. A tipping wrap 56 is disposed about the outer plug wrap 55 and the tobacco rod wrap 53 to hold the tobacco rod 51 along with the flavouring component 43 and the filter rod 52 together.

Figure 4:
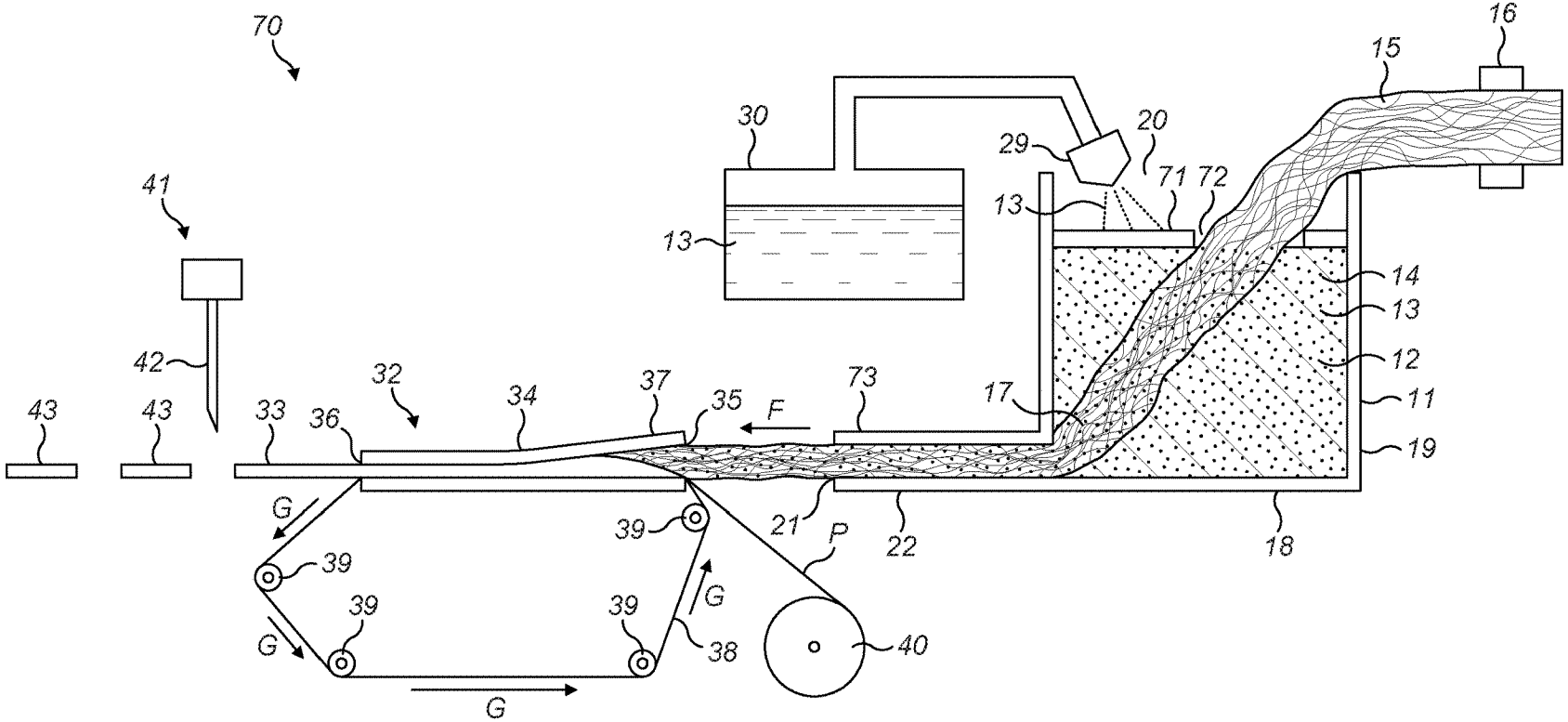
FIG. 4 shows a schematic cross-sectional view of a second embodiment of an apparatus of the invention.

An apparatus 70 of a second embodiment for the manufacture of flavouring components of the invention is shown in FIG. 4 and is similar to the apparatus 10 of the first embodiment. Like features retain the same reference numerals and a detailed description of such like features will not be repeated.

A difference with the apparatus 70 of the second embodiment over the apparatus 10 of the first embodiment is that, in the apparatus 70 of the second embodiment, the screw conveyor is omitted. Rather, a piston is provided at the upper aperture 20 of the container. The piston is in the form of a plate 71 substantially parallel to the base portion 18 of the container 11. The plate 71 substantially closes the upper aperture 20 of the container 11. The plate 71 comprises an orifice 72 for allowing the carrier material 15 to be introduced within the container 11. The plate 71 is configured to pressurise the mixture 12 and to consequently urge the mixture 12 towards the outlet 21. As the mixture 12 has a doughy consistency, the mixture 12 does not overflow through the orifice 72 of the plate when the plate pressurises the mixture 12.

An additional difference with the apparatus 70 of the second embodiment over the apparatus 10 of the first embodiment is that, in the apparatus of the second embodiment, the outlet 21 of the container 11 comprises a die 73. The die 73 is configured to shape the flavouring material 17 as it is expelled through the outlet 21, to form the rod 33 of flavouring material 17. The die 73 is configured to form a cylindrical rod 33 of flavouring material 17. However, various different configurations of due are intended to fall within the scope of this invention.

After passing through the die 73, the length of flavouring material 17 is wrapped at a wrapping station 32 as per the first embodiment of the apparatus 10 of the invention described previously.

Following the wrapping station 32, the rod 33 of flavouring material 17 is cut into discrete rods of flavouring material 17 at a cutting station 41 as per the first embodiment of the apparatus 10 of the invention described previously.

Figure 5:
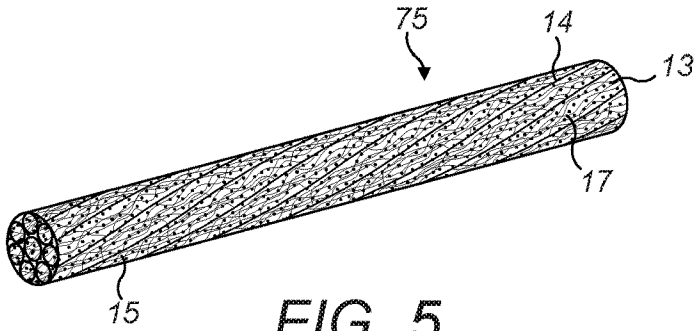
FIG. 5 shows a flavouring component manufactured using a variant of the apparatus of FIG. 4.

In a variant, the die could have an internal profile configured to provide a helical profile to the rod 33 of flavouring material 17. A helical rod 75 of flavouring material 17 formed using such a die is represented in FIG. 5. Providing a helical rod 75 of flavouring material 17 may allow the flavouring particles 14 to adhere more efficiently to the carrier material 15.

The apparatuses and the methods of the invention provide an alternative and efficient way of manufacturing flavouring components for smoking articles. In particular, the apparatuses and the methods of the invention allow manufacturing flavouring component in which the flavourant particles are embedded in a fibrous carrier material. Therefore, the apparatuses and the methods of the invention avoid having to implement a step of filling the flavourant particles in tubes, which can be relatively costly, time consuming and difficult to implement in a continuous horizontal process.

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products and other nicotine delivery product such as aerosol generation devices including e-cigarettes. The smoking article may be provided with a filter for the gaseous flow drawn by the smoker.

In order to address various issues and advance the art, the entirety of this disclosure shows by way of illustration various embodiments in which the claimed invention(s) may be practiced and provide for superior flavouring component and apparatus and method of manufacture a flavouring component for a smoking article. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. An apparatus for manufacturing a flavoring component for a smoking article, the flavoring component comprising a rod of flavoring material, the flavoring material comprising a carrier material and flavoring particles adhered to the carrier material by means of a binder, the apparatus comprising:

a container containing a mixture of the binder and the flavoring particles, the container comprising an outlet; and a supply of carrier material;

wherein the apparatus is configured to convey a length of carrier material through the mixture within the container so that the flavoring particles adhere to the length of carrier material by means of the binder to form a length of flavoring material, and is configured to convey the length of carrier material out of the outlet and extrude the length of flavoring material to form the rod of flavoring material.

2. An apparatus according to claim 1, wherein the length of carrier material is a continuous length of carrier material, and wherein the apparatus is configured to convey the continuous length of carrier material through the mixture so that the flavoring particles adhere to the continuous length of carrier material by means of the binder to form a continuous length of flavoring material, and is configured to extrude the continuous length of flavoring material to form a continuous rod of flavoring material.

3. An apparatus according to claim 1, wherein the apparatus comprises means for conveying the mixture towards the outlet of the container.

4. An apparatus according to claim 3, wherein the conveying means comprise a screw conveyor located in the container and facing the outlet of the container.

5. An apparatus according to claim 3, wherein the conveying means comprise means for pressurizing the mixture in the container.

6. An apparatus according to claim 1, wherein the apparatus comprises means for pulling the length of flavoring material out of the container through the outlet.

7. An apparatus according to claim 1, wherein the outlet comprises a die and wherein the die is configured to shape the extruded length of flavoring material as the length of flavoring material is expelled through the outlet to form the rod of flavoring material, wherein the die is configured to provide a helical profile to the rod of flavoring material.

8. An apparatus according to claim 1, comprising means for twisting the length of carrier material as it is conveyed through the mixture.

9. A method of manufacturing a flavoring component for a smoking article, the flavoring component comprising a rod of flavoring material, the flavoring material comprising a carrier material and flavoring particles adhered to the carrier material by means of a binder, the method comprising:

filling a container with a mixture comprising the binder and the flavoring particles, the container having an outlet;

supplying a length of carrier material;

conveying the length of carrier material through the mixture within the container towards the outlet so that the flavoring particles adhere to the length of carrier material by means of the binder to form a length of flavoring material; and conveying the length of the carrier material out of the outlet to extrude the length of flavoring material to form the rod of flavoring material.

10. A method according to claim 9, wherein the length of carrier material is a continuous length of carrier material, and wherein the method comprises conveying the continuous length of carrier material through the mixture so that the flavoring particles adhere to the continuous length of carrier material by means of the binder to form a continuous length of flavoring material, and extruding the continuous length of flavoring material to form a continuous rod of flavoring material.

11. A method according to claim 9, comprising conveying the mixture towards the outlet of the container.

12. A method according to claim 11, comprising using a screw conveyor to convey the mixture towards the outlet of the container.

13. A method according to claim 9, comprising pulling the length of flavoring material out of the container through the outlet.

14. A method according to claim 9, comprising using a die to shape the extruded length of flavoring material as the length of flavoring material is expelled through the outlet, and comprising using the die to provide a helical profile to the length of flavoring material as the length of flavoring material passes through the die.

15. A method according to claim 9, comprising twisting the length of carrier material as it is conveyed through the mixture.

* * * * *